US007569490B2

(12) United States Patent
Staud

(10) Patent No.: US 7,569,490 B2
(45) Date of Patent: Aug. 4, 2009

(54) ELECTROCHEMICAL ETCHING

(75) Inventor: Norbert Staud, San Jose, CA (US)

(73) Assignee: WD Media, Inc., San Jose, CA (US)

( * ) Notice: Subject to any disclaimer, the term of this patent is extended or adjusted under 35 U.S.C. 154(b) by 114 days.

(21) Appl. No.: 11/081,326

(22) Filed: Mar. 15, 2005

(65) Prior Publication Data

US 2006/0207889 A1 Sep. 21, 2006

(51) Int. Cl.
*H01L 21/302* (2006.01)

(52) U.S. Cl. ..... 438/745; 438/750; 438/752; 205/640

(58) Field of Classification Search ..... 438/745, 438/750, 752; 205/640.644
See application file for complete search history.

(56) References Cited

U.S. PATENT DOCUMENTS

| | | | | |
|---|---|---|---|---|
| 4,032,379 | A * | 6/1977 | Czirr et al. | 216/108 |
| 4,279,707 | A | 7/1981 | Anderson et al. | |
| 4,303,482 | A * | 12/1981 | Buhne et al. | 205/646 |
| 4,412,934 | A | 11/1983 | Chung et al. | |
| 4,472,248 | A | 9/1984 | Koskenmaki | |
| 4,483,781 | A | 11/1984 | Hartman | |
| 4,537,706 | A | 8/1985 | Severson, Jr. | |
| 4,634,551 | A | 1/1987 | Burns et al. | |
| 4,642,168 | A | 2/1987 | Imai | |
| 5,071,510 | A | 12/1991 | Findler et al. | |
| 5,167,776 | A | 12/1992 | Bhaskar et al. | |
| 5,194,127 | A * | 3/1993 | Endoh et al. | 361/500 |
| 5,262,021 | A | 11/1993 | Lehmann et al. | |
| 5,532,094 | A * | 7/1996 | Arimura et al. | 216/106 |
| 5,614,484 | A | 3/1997 | Panandiker | |
| 5,705,089 | A * | 1/1998 | Sugihara et al. | 252/79.1 |
| 6,133,222 | A | 10/2000 | Vinson et al. | |
| 6,245,213 | B1 | 6/2001 | Olsson et al. | |
| 2001/0016398 | A1 * | 8/2001 | Kudelka et al. | 438/427 |
| 2004/0011666 | A1 * | 1/2004 | Taylor et al. | 205/646 |
| 2006/0207890 | A1 * | 9/2006 | Staud | 205/674 |

FOREIGN PATENT DOCUMENTS

| | | |
|---|---|---|
| EP | 0 392 738 A1 | 4/1990 |
| EP | 0 553 465 A1 | 12/1992 |
| EP | 0 563 616 A2 | 3/1993 |
| EP | 0 563 744 A2 | 3/1993 |
| EP | 0 595 053 A2 | 9/1993 |
| SE | 344 082 | 3/1972 |
| WO | WO 89/08323 | 9/1989 |

OTHER PUBLICATIONS

USTPO, Office Action mailed Jan. 16, 2009 for U.S. Appl. No. 11/081,762, (Jan. 16, 2009), whole document.

* cited by examiner

*Primary Examiner*—Lan Vinh
(74) *Attorney, Agent, or Firm*—Blakely, Sokoloff, Taylor & Zafman LLP

(57) ABSTRACT

Methods to etch a workpiece are described. In one embodiment, a workpiece is disposed within an etchant solution having a composition comprising a dilute acid and a non-ionic surfactant. An electric field is generated within the etchant solution to cause an anisotropic etch pattern to form on a surface of the workpiece.

32 Claims, 11 Drawing Sheets

Table of nickel adsorbates used

| | | |
|---|---|---|
| Benzotriazole | BTA |  |
| 2-benzimidazole propionic acid | BPA |  |
| 1H-benzimidazole-2-sulfonic acid, | BSA |  |
| 2-sulfobenzoic acid hydrate | SBA |  |
| 2-mercapto benzimidazole | MBI |  |
| A300 Corrosion Inhibitor | A300 | |
| C10-C16 alkyl benzene sulfonic acid | ABSA |  |

ELECTROCHEMICAL ETCHING

TECHNICAL FIELD

Embodiments of this invention relate to the field of etching and, more specifically in one embodiment, to the anisotropic, electrochemical etching of metallic materials.

BACKGROUND

In electrochemical etching, the etchant contains an electrolyte, which may not be capable of etching a material to be etched through a chemical reaction (i.e., the etchant does not etch merely through contact with the material). By applying an electric voltage to the etchant between the material and an electrode immersed in the etchant, an electrolytical process, however, is initiated, in which the material is one pole, (e.g., the anode), and the electrode the opposite pole. In the electrolytic process, electric current flows in the etchant, and ions in the etchant react in an etching manner with the material.

One prior art method of etching a disk surface involves the use of a strong acid (e.g., pH 2 hydrochloric acid (HCl)). However, one problem with this method is its isotropic nature (non-directional) in which sidewalls are subject to significant sideways (horizontal) etching, resulting in an undesirable aspect ratio (AR) of about 1. AR is the relationship of the etch depth and the etch width, which may be expressed as:

$$AR = \frac{Z}{(X-Y)/2} = \frac{2Z}{(X-Y)}$$

Where Z is the etch depth, Y is the width before etching, and X is the width after etching.

Etch Width may be expressed as:

$$X - Y = \frac{2}{AR} * Z$$

An AR of 1 adds twice the etch depth Z to the width of the originally exposed gap area of the disk surface. An AR of 1.5 translates to an added etch width that is 1.33 times the depth Z during the etch process. For example, for a target depth Z of 40 nanometers (nm), an AR of 1 results in 80 nm being added to the starting width, whereas an AR of 1.5 adds 53 nm and an AR of 2 adds 40 nm. FIG. 1 illustrates a difference between an AR of 1 and an AR of 2 for a typical electrochemical, wet-etch process. An embossable layer deposited over a nickel-phosphorous (NiP) layer of a disk substrate forms a width Y prior to a wet-etch process. The recessed area formed in the NiP layer after the etching process has a width X and a depth Z. The acidic etchant typically produces an isotropic effect that undercuts the embossable layer to react with the NiP layer in all directions. For a depth Z of 50 nm, an AR of 1 produces a post-etch width of about 200 nm, while an AR of 2 produces a post-etch width of about 150 nm. Because the width of the recessed area is significantly greater than the depth in typical wet-etch processes (i.e., AR values around 1), achieving high area densities is virtually impossible.

U.S. Pat. No. 6,245,213 to Olsson et al. (hereinafter "Olsson") describes a low concentration etchant, which etches isotropically in the absence of an electric field, etches anisotropically and at a higher rate, in the presence of the electric field. Olsson discloses that it is possible to etch lines and grooves having greater depth than width, with experiments showing a depth-to-width ratio of 3.5:1 when etching thin copper foil. However, there appears to be limits to how high the depth-to-width may be because the anisotropic nature of the etching process is based mainly on the relatively low concentration of the etchant.

FIG. 2 illustrates a graph showing a theoretical, calculated widening of the initial gap width as a function of the AR for an etch process for a targeted etch depth of 40 nm. As discussed above, an AR value of 1 adds 80 nm to the initial gap width, and decreases (not linearly) as the AR value increases. An AR value of 3 only adds about 25 nm to the initial gap width. An AR value greater than 1 may be desirable in certain manufacturing processes such as in the manufacture of a discrete track recording disk in order to maximizing its recording density.

BRIEF DESCRIPTION OF THE DRAWINGS

The present invention is illustrated by way of example, and not limitation, in the figures of the accompanying drawings in which.

DETAILED DESCRIPTION

In the following description, numerous specific details are set forth such as examples of specific materials or components in order to provide a thorough understanding of the present invention. It will be apparent, however, to one skilled in the art that these specific details need not be employed to practice the invention. In other instances, well known components or methods have not been described in detail in order to avoid unnecessarily obscuring the present invention.

The terms "above," "below," and "between" as used herein refer to a relative position of one layer or element with respect to other layers or elements. As such, a first element disposed above or below another element may be directly in contact with the first element or may have one or more intervening elements.

Embodiments of a method to etch a workpiece are described herein. In one embodiment, a workpiece is disposed within an etchant solution having a composition comprising a dilute acid and a non-ionic surfactant. An electric field is generated within the etchant solution to cause an anisotropic etch pattern to form on a surface of the workpiece. In one embodiment, the workpiece may be composed of any material that is capable of being etched or patterned electrochemically. In one particular embodiment, the workpiece may be a disk substrate having one or more layers disposed thereon. Although embodiments of an electrochemical etch method are described herein with respect to patterning of a disk substrate, it will be appreciated that such methods are not limited to the manufacture of disk substrates. The etch methods described herein are applicable for the etching of any type of metallic material.

Figure 1:
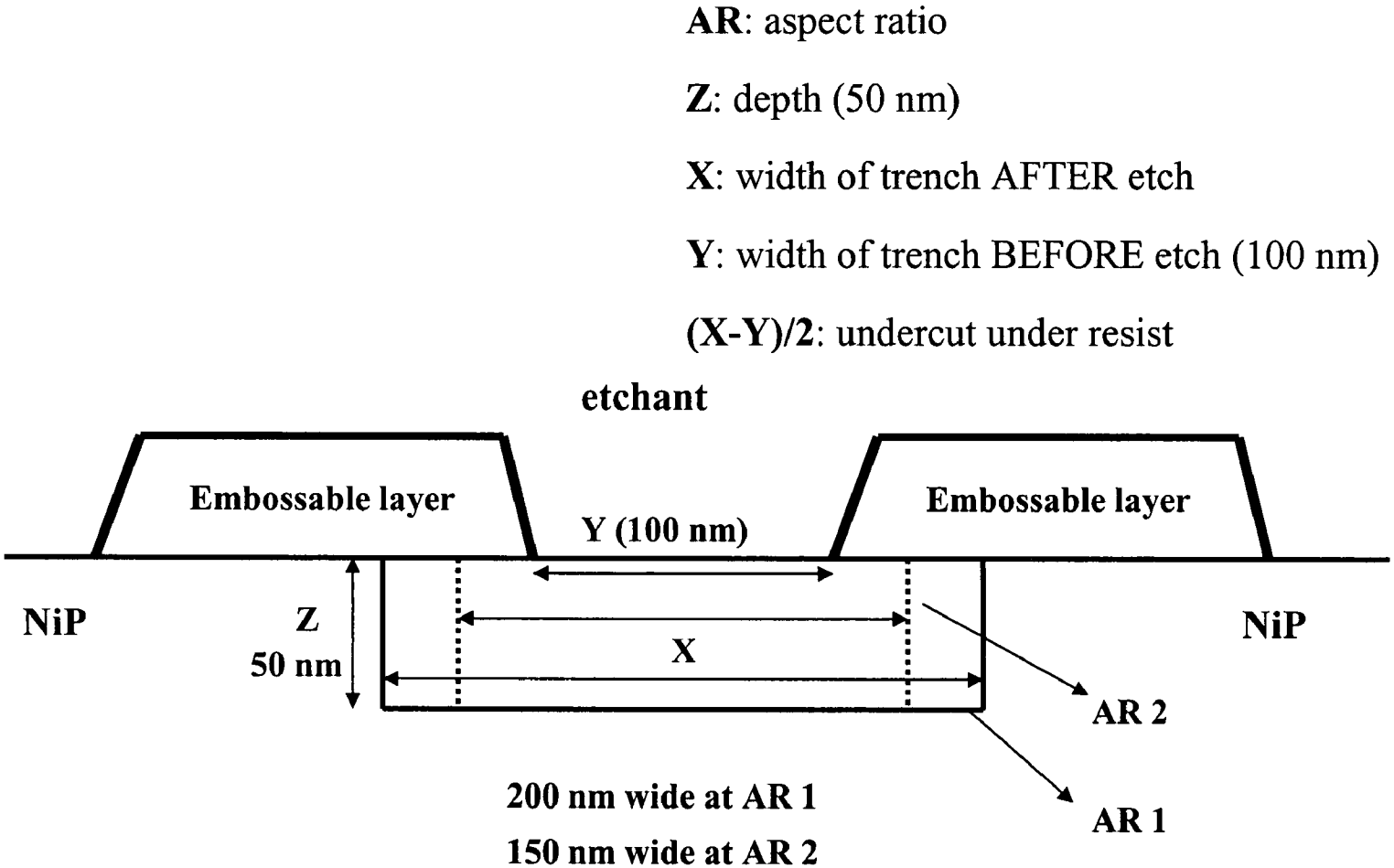
FIG. 1 illustrates the difference between different AR values for an etch process.
Figure 2:
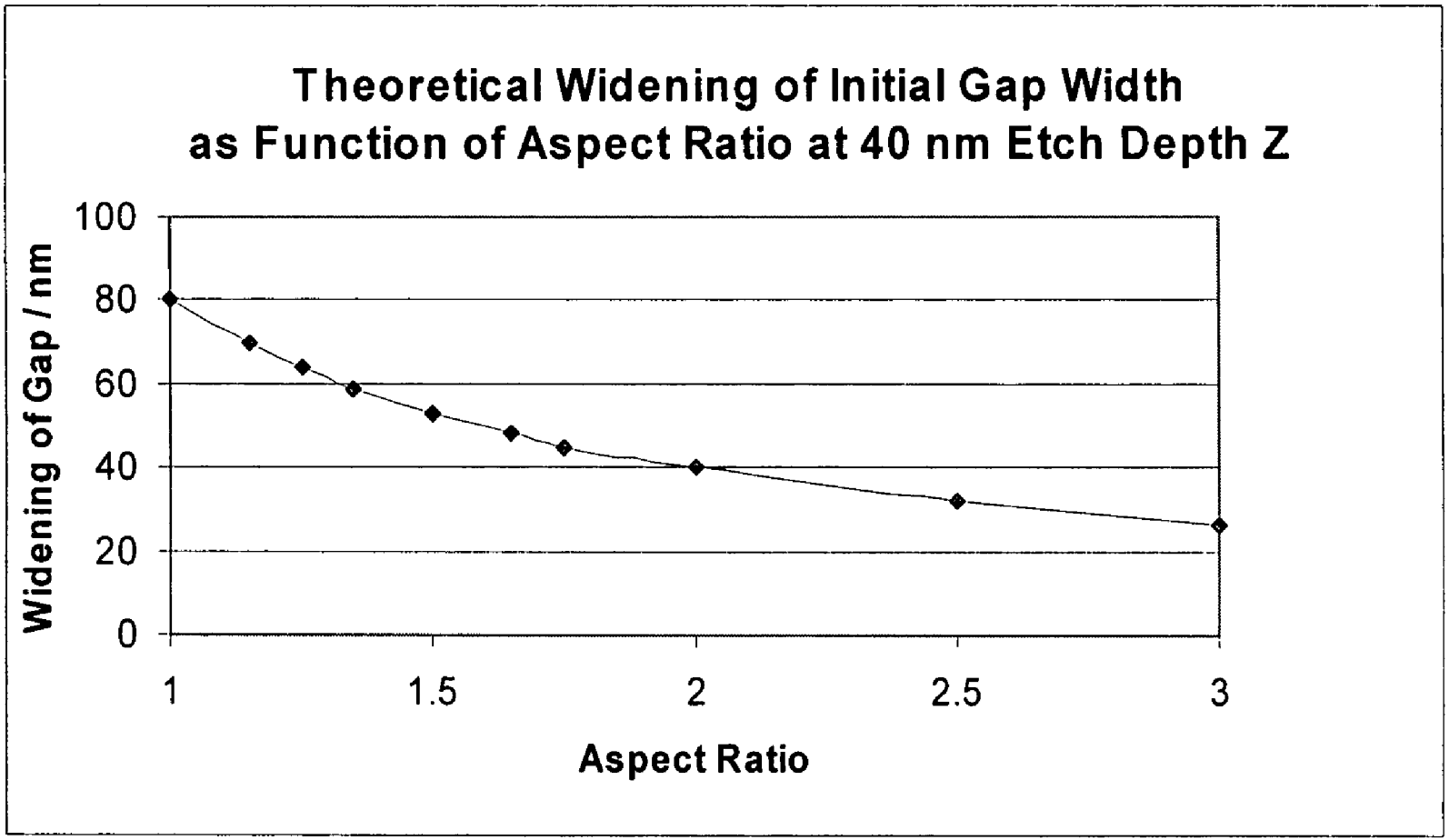
FIG. 2 illustrates a graph showing a theoretical, calculated widening of the initial gap width as a function of the AR for an etch process.
Figure 3:
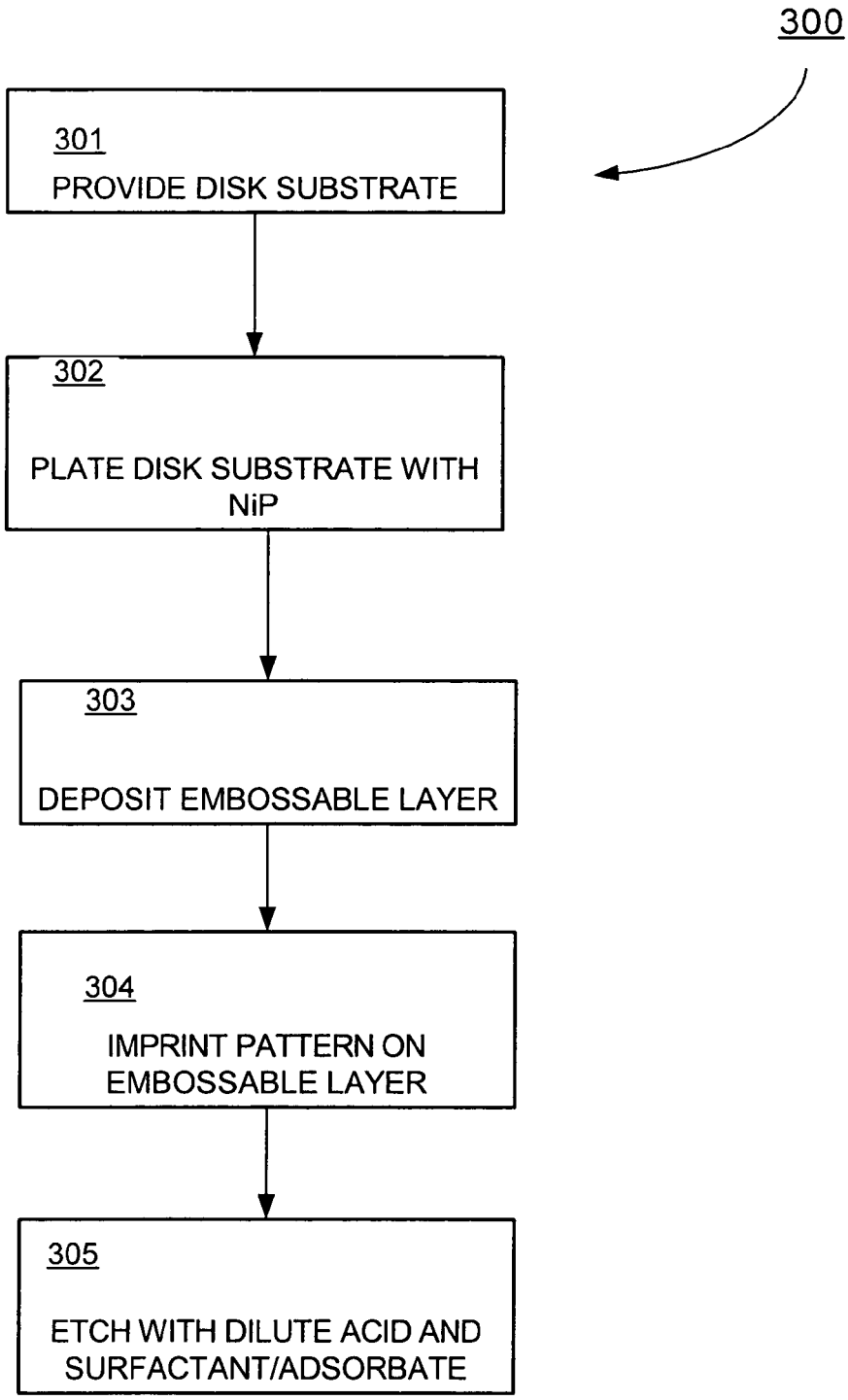
FIG. 3 illustrates a block diagram that provides an overview of an electrochemical, wet-etch process for forming a DTR pattern on the surface of a disk substrate.

FIG. 3 illustrates a block diagram 300 that provides an overview of an electrochemical, wet-etch process for forming an etch pattern on the surface of a workpiece such as a disk substrate. Embodiments of the etch process produce AR values greater than 1, and in one embodiment, produces AR values between about 1.3 to about 2.0. A disk substrate is first provided, block 301. The disk substrate may be composed of, by example, a metal or metal alloy material. Metal alloy substrates that may be used include, for example, aluminum-magnesium (AlMg) substrates. In an alternative embodiment, other substrate materials including polymers and ceramics may be used. The disk substrate is then plated with another metallic layer such as a NiP layer, block 302. The NiP layer may be formed by electroplating, electroless plating, or by other methods known in the art. One benefit of plating the disk substrate with a rigid or metallic material such as NiP is providing mechanical support to the disk substrate for subsequent texturing, polishing, and/or patterning processes that may be used in the disk manufacturing process.

The NiP layer may then be coated with a resist, an imprintable, or other embossable layer material that in one embodiment, serve as a mask for the desired pattern during the etching process, block 303. Spin coating, dip coating, and spray coating are just some methods of depositing the embossable layer on the NiP layer. The embossable layer is then imprinted with the desired pattern, block 304. In one embodiment, a stamper having a negative, or inverse template of the desired pattern may be pressed against the embossable layer to form an initial pattern of raised areas and recessed areas. The recessed areas may then undergo an initial etching process (e.g., plasma ashing) to remove the embossable material and expose the NiP layer. In an alternative embodiment, reactive gas etching may be used to expose the NiP layer. The exposed NiP areas may then undergo another etching process—an electrochemical, wet-etch—that includes an etchant made of a dilute acid combined with a non-ionic surfactant and/or surface adsorbate, block 305. In one embodiment, the etchant may be dilute acid such as citric acid and a non-ionic surfactant (e.g., alkyl ethoxylates). In another embodiment, the etchant may be a dilute acid having a metal adsorbate (e.g., nickel adsorbate). In another embodiment, the etchant may be made of a dilute citric acid, a non-ionic surfactant, and a nickel adsorbate.

As described in greater detail below, the non-ionic surfactant and/or adsorbate portions of the etchant produce an anisotropic process, in which the etchant reacts faster with the NiP in a vertical direction relative to the horizontal direction. As such, the widths of the recessed areas are minimized, resulting in AR values significantly greater than 1. Non-ionic surfactants and adsorbates are chemicals that affect the surface properties of NiP. Non-ionic surfactants and adsorbates may be responsible for increased AR by preferential, strong adsorption to sidewalls of recessed areas because of small electric field gradients between sidewalls and the center of recessed area. This results in faster electro-migration and diffusion from bulk electrolyte to the sidewalls. The adsorbates may be preferentially distributed and adsorbed near the sidewalls of the recessed areas and therefore enhance reaction of the acid with the NiP near the center of the recessed area.

In one embodiment, the electrochemical etch process discussed herein may be used to form a discrete track recording (DTR) pattern in a disk. A DTR pattern may be formed by nano-imprint lithography (NIL) techniques, in which a rigid, pre-embossed forming tool (a.k.a., stamper, embosser, etc.), having an inverse pattern to be imprinted, is pressed into an embossable film (i.e., polymer or embossable material) disposed above a disk substrate to form an initial pattern of compressed areas. This initial pattern ultimately forms a pattern of raised and recessed areas. After stamping the embossable film, an etching process is used to transfer the pattern through the embossable film by removing the residual film in the compressed areas. After the imprint lithography process, another etching process may be used to form the pattern in a layer (e.g., substrate, nickel-phosphorous, soft magnetic layer, etc.) residing underneath the embossable film. The resulting DTR track structure contains a pattern of concentric raised areas and recessed areas under a magnetic recording layer. The raised areas (also known as hills, lands, elevations, etc.) are used for storing data and the recessed areas (also known as troughs, valleys, grooves, etc.) provide inter-track isolation to reduce noise. The above mentioned etching process in the manufacture of a DTR disk is an important process to define the width and depth of grooves that separate the raised areas from each other. For a given target depth, it is desirable to keep the final width of the groove as narrow as possible in order to achieve high storage or magnetic area densities.

Figure 4A:
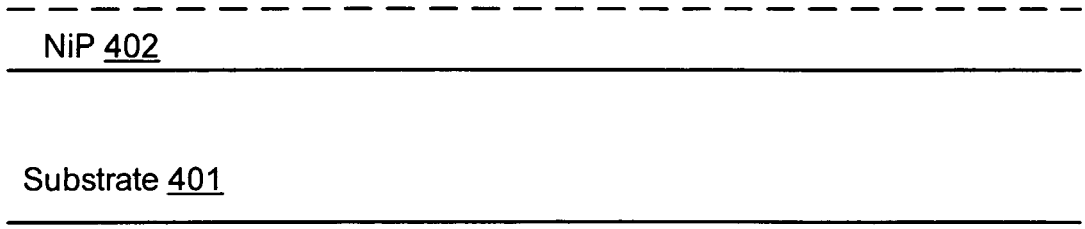
FIG. 4A shows an expanded cross sectional view illustrating one embodiment of preparatory stages of a disk substrate prior to an electrochemical, wet-etch process, with a NiP layer plated over the disk substrate.
Figure 4B:
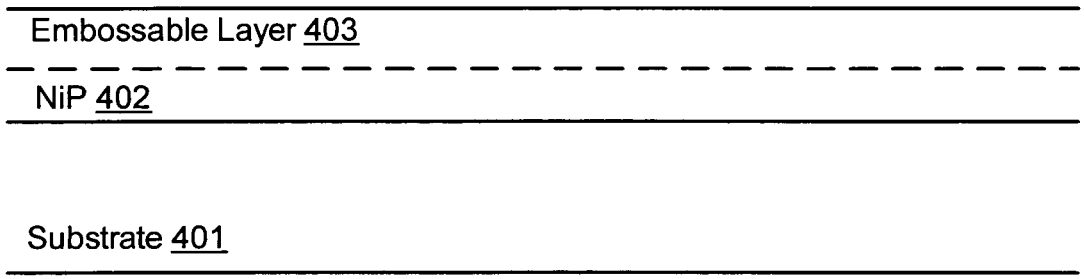
FIG. 4B illustrates the disk substrate of FIG. 4A with an embossable layer deposited over the NiP layer.
Figure 4C:
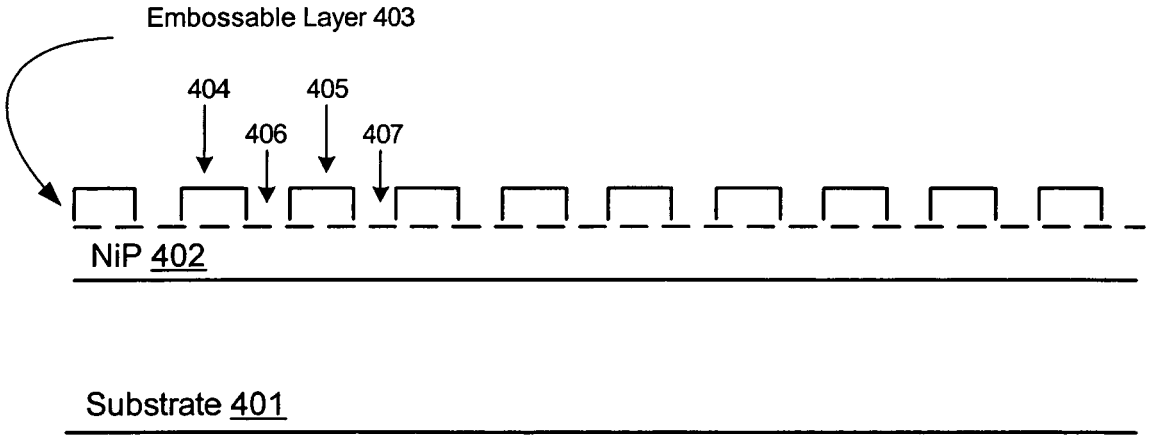
FIG. 4C illustrates the disk substrate of FIG. 4A after it has been imprinted with a pattern of raised and recessed areas.

FIGS. 4A-4C show expanded cross sectional views illustrating one embodiment of preparatory stages of a disk substrate prior to an electrochemical, wet-etch process. In one embodiment, the etch process is used to form a DTR on a NiP layer of a longitudinal magnetic recording disk. For clarity of explanation, the various layers illustrated in FIGS. 4A-4C are exemplary and may not be scaled to representative sizes. As shown in FIG. 4A, the DTR process begins with a NiP layer 402 plated over disk-shaped substrate 401. Disk substrate 401, as discussed above, may be made of a number of materials including metals (e.g., aluminum), glass, ceramic, or other conventional disk substrate materials known in the art. NiP layer 402 may be formed by electroplating, electroless plating, or by other methods known in the art. Plating disk substrate 401 with a rigid or metallic material such as NiP provides mechanical support to disk substrate 402 for subsequent texturing, polishing, and/or patterning processes. The surface of NiP layer 402 may be textured and polished as illustrated by FIG. 4A. In one embodiment, NiP layer 402 may be polished, for example, by a uniform etch. In alternative embodiments, other polishing techniques may be used. Polishing techniques are well known in the art; accordingly, a detailed discussion is not provided.

Next, as illustrated by FIG. 4B, NiP layer 402 may then be coated with an embossable layer 403. Spin coating, dip coating, and spray coating are several methods of disposing an embossable layer 403 on NiP layer 402. Other coating methods such as sputtering and vacuum deposition (e.g., CVD) may be used. Other embossable materials such as dye polymers, thermoplastics (e.g., amorphous, semi-crystalline, crystalline), thermosetting (e.g., epoxies, phenolics, polysiloxanes, ormosils, sol-gel) and radiation curable (e.g., UV curable, electron-beam curable) polymers may also be used. In one embodiment, for example, embossable layer 403 may have a thickness in the range of about 100-5000 Å. Embossable layer 403 may also be referred to as a "masking layer" or a "stencil layer."

Next, as illustrated by FIG. 4C, embossable layer 403 is shown after it has been imprinted with a pattern of raised areas 404, 405 and recessed areas 406, 407, followed by an etching (i.e., ashing) process to remove embossable material in the recessed areas. The imprinting of embossable layer 403 may utilize, for example, nano-imprint lithography techniques that are well known in the art. In one embodiment, a stamper (not shown in FIG. 4C) bearing a discrete track recording pattern, may be used to imprint embossable layer 403 to form raised areas 404, 405 and recessed areas 406, 407. Because of the thickness of the embossable layer 403, the imprint of raised and recessed areas is not likely to press into NiP layer 402. Alternatively, if embossable layer 403 is relatively thin, it may be stamped to leave very little embossable material in the recessed areas 406, 407. Subsequently, embossable material in the recessed areas 406, 407 may be removed to expose NiP layer 402 as shown. In one embodiment for example, plasma ashing may be used to remove embossable material in recessed areas 406, 407 to expose NiP layer 402. Alternatively, other etching methods may be used to remove embossable material in at least the recessed areas, for example, using chemical etching, electron beam (e-beam) etching, ion-beam etching (passive or reactive) sputter etching, and plasma etching with reactive gases. For certain types of etching (e.g., chemical), embossable material may be removed from both the raised areas 404, 405 and recessed areas 406, 407 at approximately a similar rate. Chemical etching (i.e., using an etchant that reacts only with embossable material) removes embossable layer 403 in both the raised areas 404, 405 and recessed areas 406, 407 until NiP layer 402 is exposed in the recessed areas 406, 407.

Figure 10:
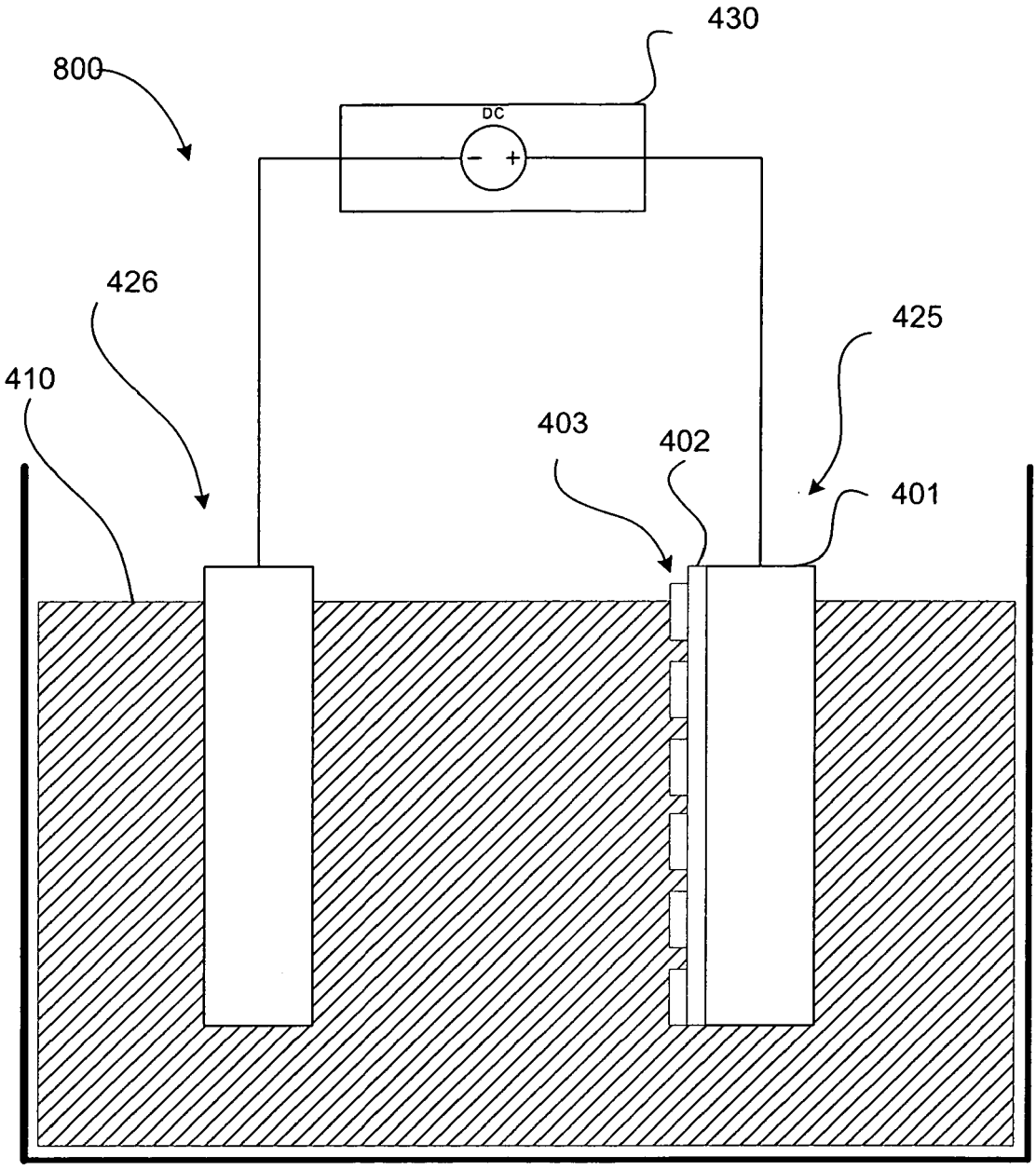
FIG. 10 is a schematic view of an electrochemical bath.

The NiP plated disk substrate is now prepared for the electrochemical, wet-etch process to form recessed areas in the NiP layer 402. FIG. 10 is a schematic view of a bath 800 to carry out the electrochemical etch process to form recessed areas in the NiP layer 402. Etchant 410 has a composition, in one embodiment, that includes a dilute acid with a surfactant. In another embodiment, etchant 410 has composition that includes a dilute acid and a nickel adsorbate, or a combination of dilute acid, non-ionic surfactant, and nickel adsorbate. Disk substrate 425 is disposed adjacent to or parallel to a first electrode 426 within the solution of etchant 410. Current is supplied to disk substrate 425 and first electrode 426 by power supply/controller 430. By applying an electric voltage in etchant 410 between NiP layer 402 and first electrode 426, an electrolytical process is initiated, in which NiP layer 402 is one pole, (e.g., the anode), and first electrode 426 the opposite pole (e.g., the cathode). In the electrolytic process, electric current flows in the etchant, and ions in the etchant react in an etching manner with the NiP layer 402. Disk substrate 425 and first electrode may be spaced between about 1 mm to about 10 mm. Alternatively, another spacing may be used.

Figure 5A:
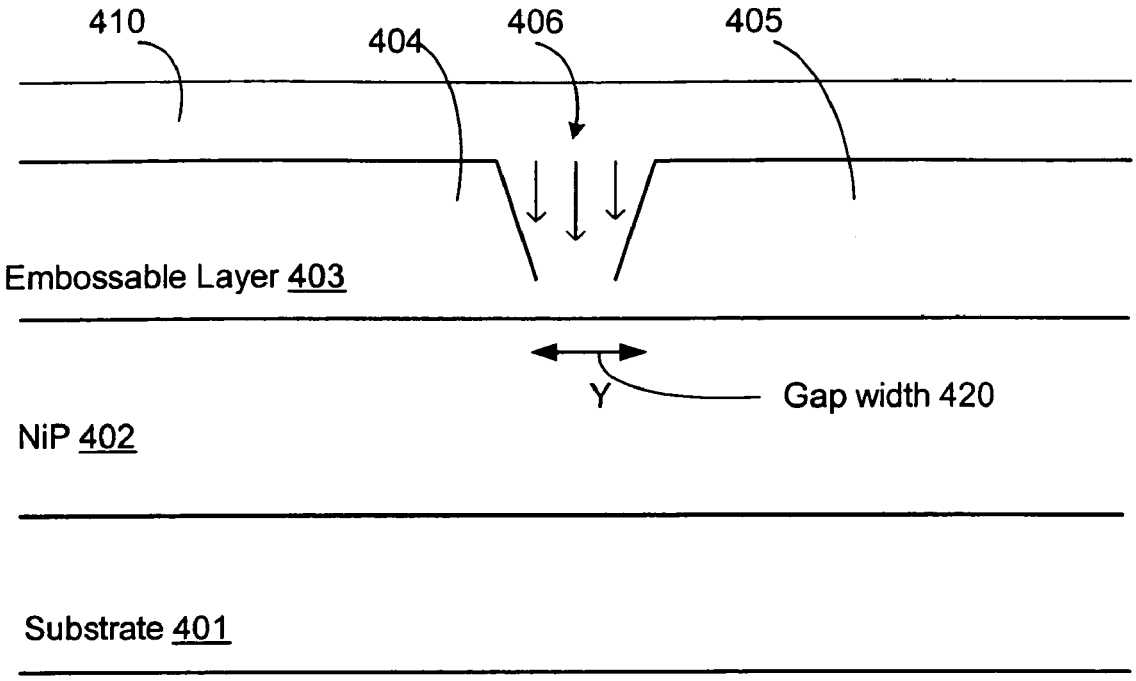
FIG. 5A shows an enlarged cross sectional view of the disk substrate of FIG. 4A with an electrochemical etchant dispensed over the embossable layer.
Figure 5B:
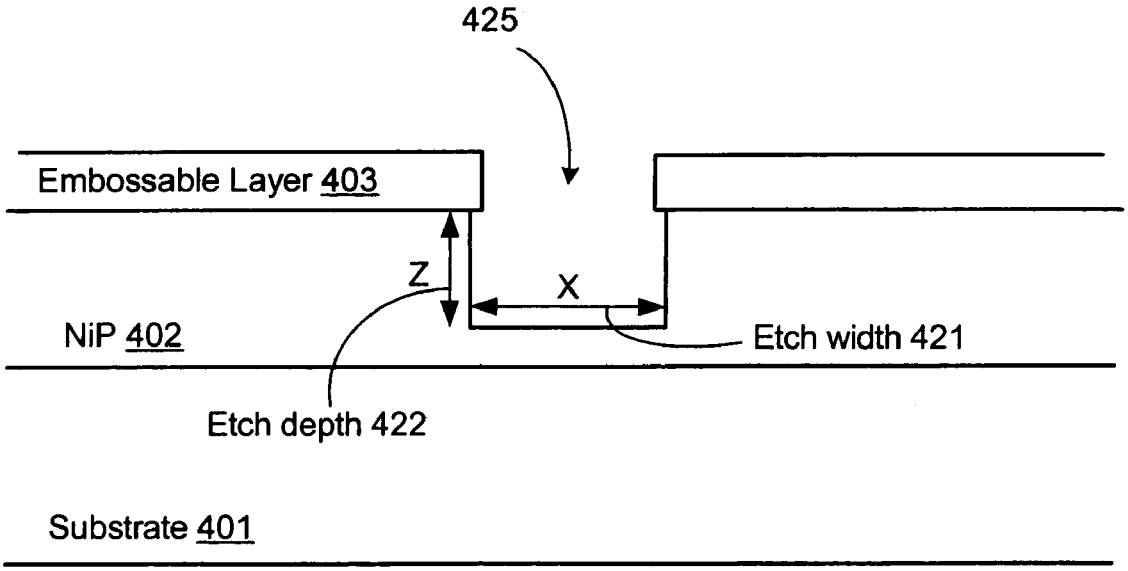
FIG. 5B shows the disk substrate of FIG. 4A with a recessed area formed within the NiP layer.

FIGS. 5A-5B illustrate enlarged views of raised areas 404, 405 that define recessed area 406 that exposes a surface of NiP layer 402. FIG. 5A illustrates etchant 410 dispensed over embossable layer 403 and the exposed area (i.e., recessed area 406) of NiP layer 402. Raised areas 404, 405 of NiP layer 404 define recessed area 406 which also forms the initial gap width (Y) 420 of the surface of NiP layer 402 to be etched. Although the dispensing of etchant 410 is shown simplistically, the disk substrate may be submersed in a solution or bath of etchant 410. The directional arrows within etchant 410 are intended to represent the direction of etch into NiP layer 402. Etchant 410 is formulated to react only with NiP layer 402 (and in particular, not with embossable layer 403). FIG. 5B illustrates a recessed area 425 formed within NiP layer 402 substantially below recessed area 406. Recessed area 425 may be defined by a final etch width (X) 421 and an etch depth (Z) 422. In one embodiment, the use of the various etchants described herein produces recessed area 425 with an AR value that is significantly greater than 1.

In one embodiment, etchant 410 may be made of an acid such as oxalic acid (also known as ethanedioic acid, $HO_2CCO_2H$), and citric acid (also known as 2-hydroxy-1,2,3-propanetricarboxylic acid, $HO_2CCH_2C(OH)(CO_2H)CH_2CO_2H$), each having a pH greater than or equal to 2, with the addition of a non-ionic surfactant such as an alkyl ethoxylate blend (C7-C10 alkyl chain, molecular weight about 550). The addition of the non-ionic surfactant, in one embodiment, increases the AR significantly and reproducibly to an AR above 1.3, relative to an AR value measured using only hydrochloric acid, by producing an anisotropic etch effect.

Figure 11:
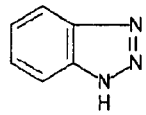
FIG. 11 is a table showing examples of adsorbates.
Figure 11:
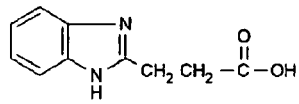
Figure 11:
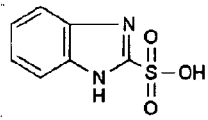
Figure 11:
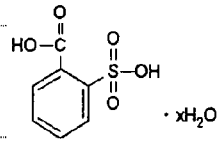
Figure 11:
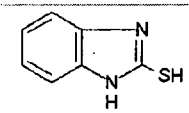
Figure 11:
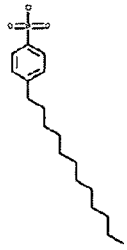

In an alternative embodiment, recessed areas may be anisotropically etched by a combination of a dilute acid with a NiP adsorbate. The adsorbate component of etchant 410 may act as a corrosion inhibitor to prevent the acid from reacting with the NiP near the sidewalls of the recessed areas, thereby creating a greater reaction bias near a center portion the recessed areas. Examples of adsorbates are shown in the table of FIG. 11, which include, but is not limited to, benzotriazole (BTA), 2-benzimidazole proprionic acid (BPA), 1H-benzimidazole-2-sulfonic acid (BSA), 2-sulfobenzoic acid hydrate (SBA), 2-mercapto benzimidazole (MBI), A300 corrosion inhibitor (A300), and C10-C16 alkyl benzene sulfonic acid (ABSA). In other embodiment, an anisotropic etch effect may also be achieved by the addition of a NiP adsorbate to the dilute acid/non-ionic surfactant etchant. In one embodiment, the addition of an adsorbate to the etchant increases the AR significantly and reproducibly to an AR above 1.4, relative to an AR value measured using only hydrochloric acid. The etchant with the non-ionic surfactant/adsorbate mixture may be, in one embodiment, a citric acid/alkyl ethoxylate/benzene sulfonic acid mixture ranging from a 3.5% solution to a 0.025% solution. The 3.5% solution includes citric acid of about 8.75 g/l (45.0 mM), benzene sulfonic acid of about 1.75 g/l (5.4 mM), and a pH of about 2.3. The 0.025% solution includes citric acid of about 0.063 g/l (0.32 mM), benzene sulfonic acid of about 0.0125 g/l (0.039 mM), and a pH of about 3.7. The conductivity of the etchants may be between about 0.43-0.12 mS.

Figure 6:
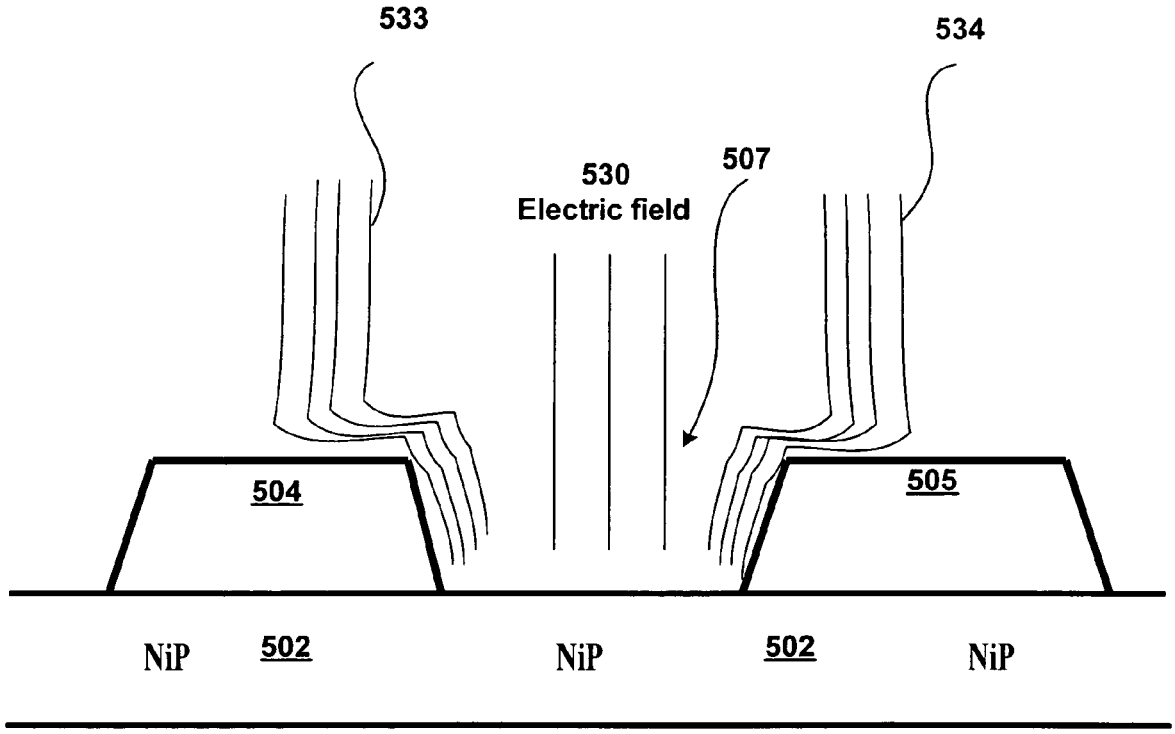
FIG. 6 illustrates the effect on the electric field by the embossable layer during the electrochemical, wet-etch process.

FIG. 6 illustrates the effect of the electric field by the embossable layer during the electrochemical, wet-etch process. In one embodiment, non-ionic surfactants and adsorbates may be responsible for increased AR by preferential, strong adsorption to sidewalls of recessed areas because of small electric field gradients between sidewalls and the center of recessed area. This results in faster electro-migration and diffusion from bulk electrolyte to the sidewalls. For example, electric field 530 is shown disposed near recessed area 507 between raised areas 504, 505. Because the embossable material of raised areas 504, 505 is non-conductive, higher electric field gradients 533, 534 are formed near the sidewalls of raised areas 504, 505. The electric field gradients 533, 534 cause the adsorbates and non-ionic surfactants to accumulate near the edges of the sidewalls (i.e., gap width ends) of raised areas 504, 505, and preferentially adsorb on the NiP layer 502 near the side walls, thereby promoting anisotropic etching of the NiP layer.

Example 1 of an etchant for anisotropic, wet-etch process. A first control etch process was first performed on a NiP layer to measure AR values under conditions that did not include a non-ionic surfactant and/or adsorbate. The etchant used was HCl having a pH of 2.1. Prior to etching, the gap width (e.g., gap width 420) formed by the embossable layer was about 70-150 nm. A constant 0.5 amp current (about 3.2V) was applied to the etchant for 9 seconds, which corresponds to a current density of about 50 mA/cm$^2$ defined by the exposed area of the NiP layer. Under these conditions, an etch depth of about 60-90 nm with an AR of 1 (as confirmed by atomic force microscopy) was produced. In alternative embodiments, the current density can be between about 50-150 mA/cm$^2$ during the etch.

A second, etch process was performed using one embodiment of a novel etchant. The etchant was made of a citric acid with a non-ionic alkyl ethoxylate blend (non-ionic surfactant) and alkylbenzenesulfonic acid (adsorbate). The etchant was a 0.35% solution (citric acid, 0.875 g/l (4.5 mM); alkylbenzenesulfonic acid, 0.175 g/l (0.54 mM)). The solution had a pH of 3.1, with pK values for the citric acid between about 3.1 to about 6.4 and for the alkylbenzenesulfonic acid about 0.7. A constant 0.5 amp current (about 9.2V) was applied to the etchant for 9 seconds. The current density was greater than about 50 mA/cm$^2$ during the etch. Normalized to the first etch process (HCL control etch), an AR value of about 1.4 was produced. Compared to the HCL control that produced an AR of 1, the AR produced by this etchant proved to be statistically significant.

Example 2 of an etchant for anisotropic, wet-etch process. A higher percentage solution of etchant also produced AR values significantly greater than the HCL control. The etchant was made of a 3.5% solution of citric acid 8.75 g/l (45 mM) with a non-ionic alkyl ethoxylate blend (non-ionic surfactant) and alkylbenzenesulfonic acid 1.75 g/l (5.4 mM). The solution had a pH of 2.3, with pK values for the citric acid between about 3.1 to about 6.4 and for the alkylbenzenesulfonic acid about 0.7. A constant 0.5 amp current (about 3.2V) was applied to the etchant for 9 seconds. The current density was about 50-150 mA/cm$^2$ during the etch. Similar to the 0.35% solution described above with respect to example 1, an AR value of about 1.4 was produced.

In one embodiment, different acids besides citric acid may be used for the etchant, for example, oxalic acid, or mixtures of citric and oxalic acids acids. The dilute acid may have a pH value between about 2-4, and pK values greater than 2. Different adsorbates may also be substituted for alkylbenzenesulfonic acid in alternative embodiments. For example, BPA, BTA, ABSA, SBA, MBI, A300, or BSA may be combined with dilute citric acid to produce AR values significantly greater than 1. The etch rate may be constant or variable, with etch rates between about 5 nm/sec to about 20 nm/sec. The current applied to the etchant may be about 0.05 amp to about 2.0 amp. In one embodiment, a 0.5 amp current may be applied to the etchant for 9 seconds. In another embodiment, a 1.0 amp current for 4.5 seconds, and in yet another embodiment, a 1.5 amp current for may be applied for 3 seconds. The anode to cathode spacing of the electrodes may be between about 1-10 mm.

Figure 7:
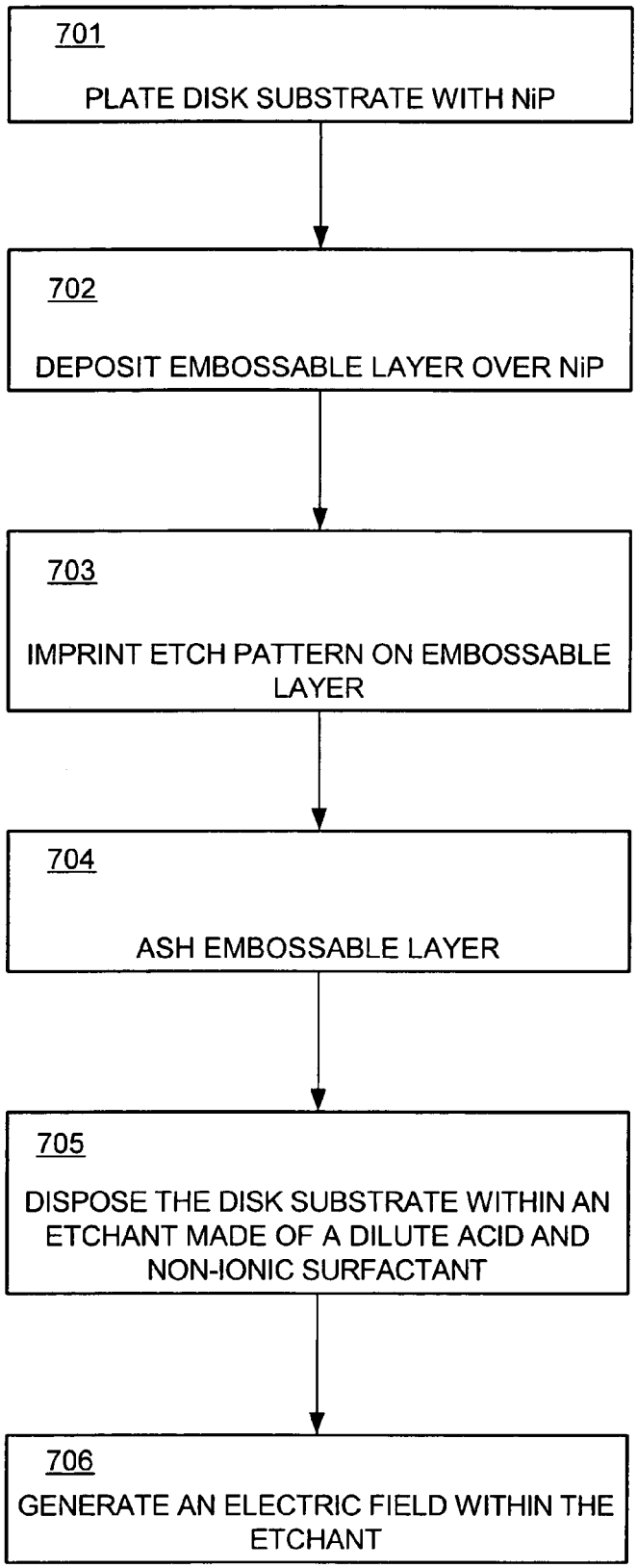
FIG. 7 is a block diagram of one method for forming a DTR pattern on a disk substrate using an anisotropic, wet-etch process.
Figure 8:
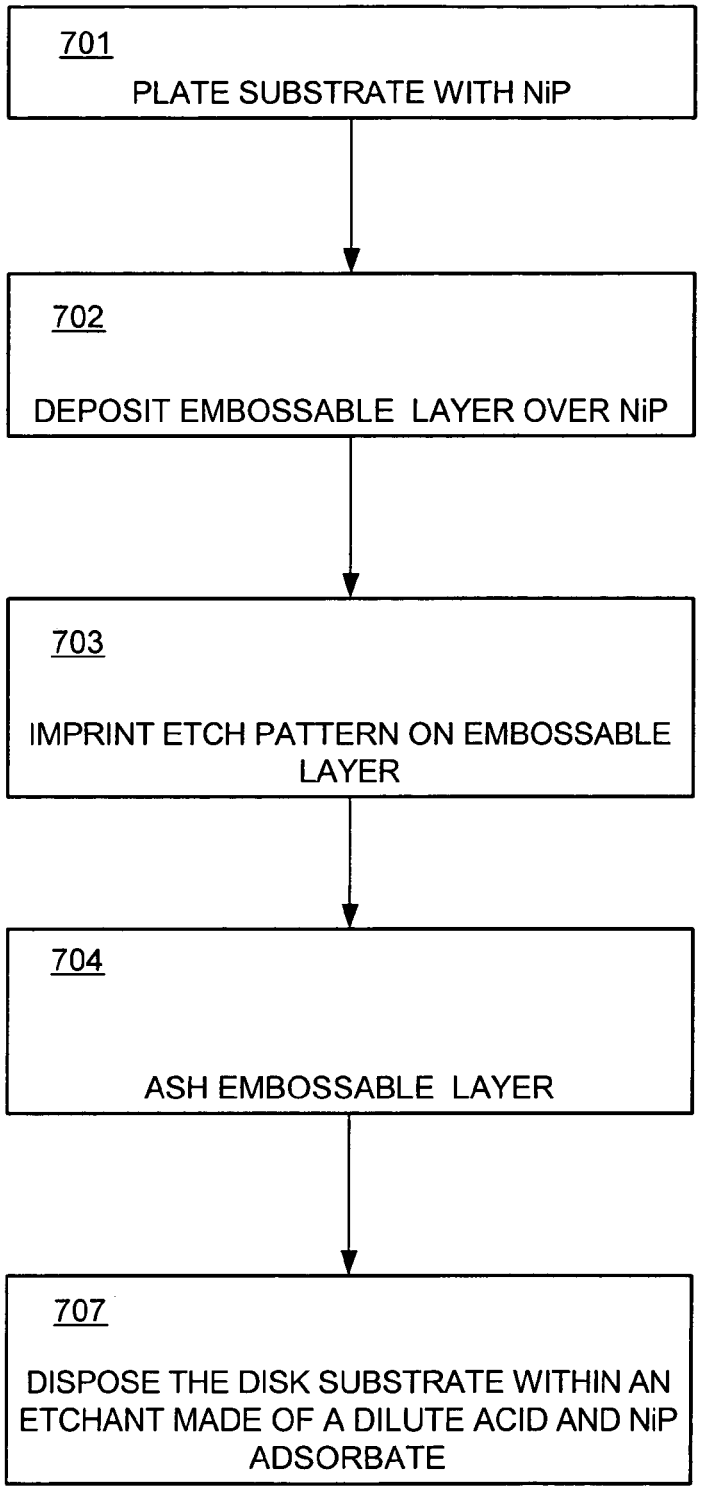
FIG. 8 is a block diagram of another method for forming a DTR pattern on a disk substrate using an anisotropic, wet-etch process.
Figure 9:
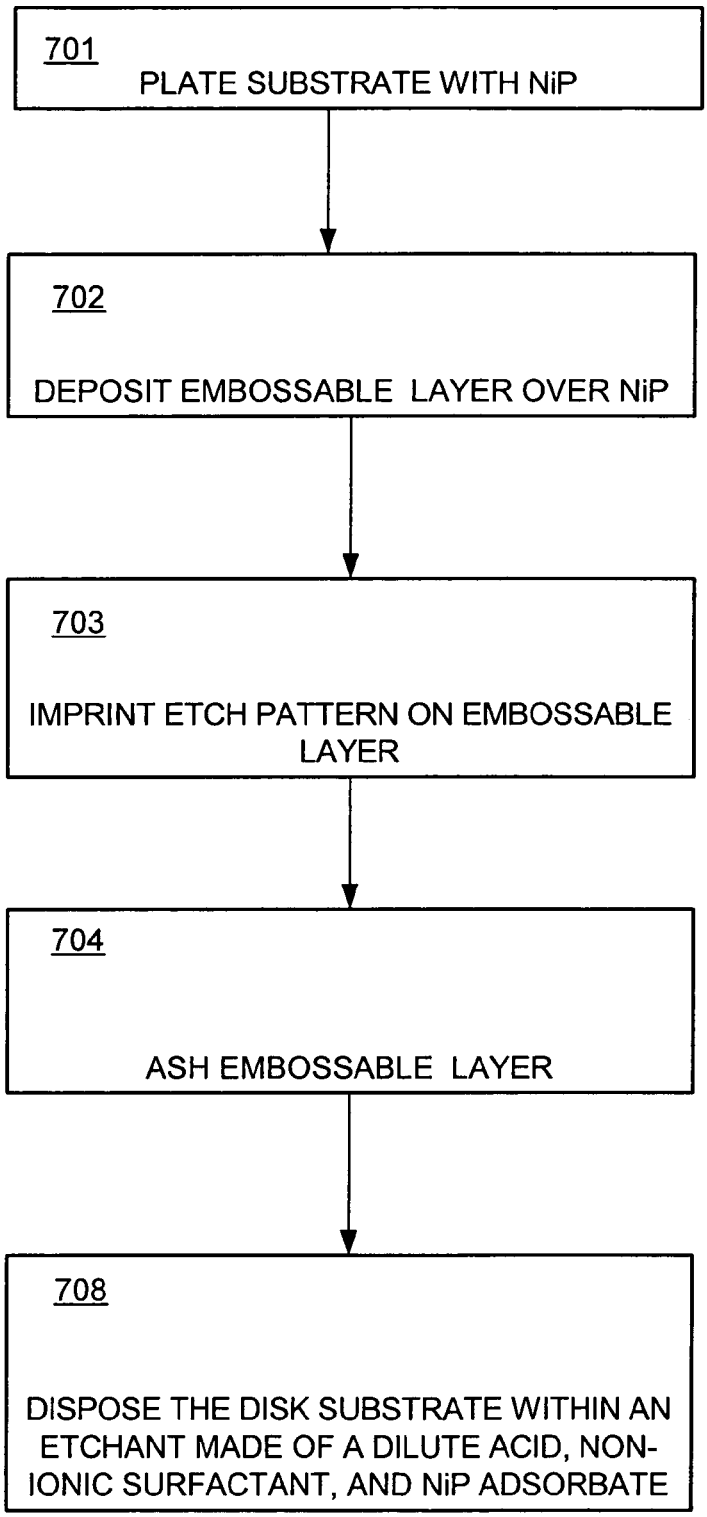
FIG. 9 is a block diagram of another method for forming a DTR pattern on a disk substrate using an anisotropic, wet-etch process.

FIGS. 7-9 are block diagrams of various methods for forming etch patterns on a disk substrate using an anisotropic, wet-etch process. The wet etch process maximizes AR values to produce disk having high storage density. In one embodiment, a disk substrate may be patterned for production as a magnetic recording disk, or other types of digital recording disks such as CD's or DVD's, or alternatively, for semiconductor wafers or display panels. A disk substrate (e.g., disk 401) is first plated with NiP layer (e.g., NiP layer 402), block 701. The disk substrate may be a metal or metal alloy such as AlMg. The NiP layer may be formed by electroplating, electroless plating, or by other methods known in the art. An embossable layer (e.g., embossable layer 403) is then deposited over the NiP layer, block 702. The embossable layer may be made of any embossable material known in the art, an electron sensitive resist, or other embossable materials. The embossable layer may be deposited over the NiP layer using spin coating, dip coating, or other methods known in the art. The embossable layer is then imprinted with a desired etch pattern, which forms an initial pattern of raised and recessed areas (e.g., raised areas 404, 405, and recessed areas 406, 407), block 703. The raised and recessed areas of the embossable layer may then be ashed to remove embossable material and expose the NiP layer in the recessed areas (e.g., as shown in FIG. 4C), block 704. In an alternative embodiment, reactive gas etching may be used to expose the NiP layer in the recessed areas.

In one embodiment, an etchant having a dilute acid with a non-ionic surfactant may be applied to the exposed surface of the NiP layer to form a recessed area (i.e., the grooves of the etch pattern), block 705. A bath similar to that described above with respect to FIG. 10 may be used apply the etchant. The dilute acid may be citric acid or oxalic acid. The non-ionic surfactant may be an alkyl ethoxylate or alkyl ethoxylate blend, with C7-C10 alkyl chain, and a molecular weight of about 550. In one particular embodiment, the etchant may be about a 4.5 mM citric acid or oxalic acid solution with alkyl ethoxylate. In another embodiment, the etchant may be about a 1.5 mM oxalic acid solution with alkyl ethoxylate. An electric field may then be generated within the etchant, block 706. In one embodiment, the electric field is generated by applying a current to the etchant. In one embodiment, a current between about 0.05 amp to 2.0 amp may be applied to the dilute acid and non-ionic surfactant. The conductivity of the etchant solution may be between about 0.43-0.12 mS. The etch rate may be constant or variable, with etch rates between about 5 nm/sec to about 20 nm/sec.

In another embodiment, an etchant having a dilute acid with a NiP adsorbate may be applied to the exposed surface of the NiP layer to form a recessed area (i.e., the grooves of the etch pattern), block 707. Adsorbates refer to chemicals that affect the surface properties of NiP. In one embodiment, adsorbates may be responsible for increased AR by preferential, strong adsorption to sidewalls of recessed areas because of small electric field gradients between sidewalls and the center of recessed area. This results in faster electro-migration and diffusion from bulk electrolyte to the sidewalls. The adsorbates may be preferentially distributed near the sidewalls of the recessed areas to localize reaction of the acid with the NiP near the center of the recessed area. Examples of adsorbates include MBI, SBA, ABSA, A300, BTA, BPA, and BSA.

In another embodiment, an etchant having a dilute acid, a non-ionic surfactant, and a NiP adsorbate may be applied to the exposed surface of the NiP layer to form a recessed area (i.e., the grooves of the etch pattern), block 708. In one particular embodiment, the etchant may be citric acid with a non-ionic alkyl ethoxylate blend and alkylbenzenesulfonic acid. The etchant may be a 0.35% solution (citric acid, 0.875 g/l, 4.5 mM; alkylbenzenesulfonic acid, 0.175 g/l, 0.54 mM), with a pH of 3.1, and pK values for the citric acid between about 3.1 to about 6.4 and for the alkylbenzenesulfonic acid about 0.7. A 0.5 amp current (about 3.2V) is applied to the etchant for about 5-9 seconds to generate a current density of about 50-150 mA/cm$^2$. The anisotropic wet-etch methods described with respect to FIGS. 7-9 produce increased AR values relative to methods that have only an acid component (e.g., HCl).

The apparatus and methods discussed herein may be used with various types of workpieces. As discussed above, the apparatus and methods discussed herein may be used for the etching of disk surfaces for the production of magnetic recording disks. The magnetic recording disk may be, for example, a DTR longitudinal magnetic recording disk having, for example, a nickel-phosphorous (NiP) plated substrate as a base structure. Alternatively, the magnetic recording disk may be a DTR perpendicular magnetic recording disk having a soft magnetic film disposed above a substrate for the base structure. In an alternative embodiment, the apparatus and methods discussed herein may be used for the manufacture of other types of digital recording disks, for example, optical recording disks such as a compact disc (CD) and a digital-versatile-disk (DVD). In yet other embodiments, the apparatus and methods discussed herein may be used in the manufacture of other types of workpieces, for example, the semiconductor wafers, and display panels (e.g., liquid crystal display panels).

In the foregoing specification, the invention has been described with reference to specific exemplary embodiments thereof. It will, however, be evident that various modifications and changes may be made thereto without departing from the broader spirit and scope of the invention as set forth in the appended claims. For example, although figures and methods herein are discussed with respect to single-sided etching, they may be used for double-sided etching as well. The specification and figures are, accordingly, to be regarded in an illustrative rather than a restrictive sense.

What is claimed is:

1. A method, comprising:

disposing a workpiece within an etchant solution having a composition comprising a dilute acid and an adsorbate, wherein the adsorbate comprises 2-benzimidazole proprionic acid;

generating an electric field within the etchant solution; and anisotropically etching a pattern in a NiP surface of the workpiece.

2. The method of claim 1, wherein the dilute acid of the etchant solution has a pH value between about 2 to 4 and a pK value greater than 2.

3. The method of claim 1, wherein disposing further comprises submerging the workpiece in a bath of the etchant solution, the bath also having an electrode disposed adjacent to the workpiece, the electrode and workpiece coupled to a power supply.

4. The method of claim 3, wherein generating the electric field further comprises applying a current between about 0.05 amp to 2.0 amp to the electrode and workpiece.

5. The method of claim 3, wherein generating the electric field further comprises applying a current between about 0.05 amp to 2.0 amp to the electrode and workpiece.

6. The method of claim 5, wherein applying the current further comprises generating an etch rate between about 5 nm/sec to about 20 nm/sec.

7. The method of claim 5, wherein applying the current produces an aspect ratio value of greater than 1 for an etch depth relative to an etch width on the surface of the workpiece.

8. The method of claim 3, wherein submerging further comprises forming a space of about 1 mm to about 10 mm between the workpiece and the electrode.

9. The method of claim 1, wherein the workpiece comprises a disk substrate, and wherein the method, before disposing the workpiece within the etchant, further comprises:

plating the NiP layer over the disk substrate;

depositing an embossable layer over the NiP layer; and imprinting the embossable layer with a stamper having a template of an etch pattern to be formed on the NiP layer.

10. The method of claim 9, wherein the etch pattern comprises a discrete track recording (DTR) pattern.

11. The method of claim 1, wherein the etchant solution further comprises a non-ionic surfactant.

12. The method of claim 11, wherein the non-ionic surfactant comprises an alkyl ethoxylate or an alkyl ethoxylate blend.

13. The method of claim 12, wherein the alkyl ethoxylate includes a C7-C10 alkyl chain and a molecular weight of about 550.

14. A method, comprising:

disposing a workpiece within an etchant solution having a composition comprising a dilute acid and an adsorbate, wherein the workpiece comprises a disk substrate having a plated Nip layer over the disk substrate;

generating an electric field within the etchant solution; and anisotropically etching a pattern in a surface of the workpiece.

15. The method of claim 14, wherein the dilute acid is selected from the group consisting of citric acid and oxalic acid.

16. The method of claim 14, wherein the dilute acid of the etchant solution has a pH value between about 2 to 4 and a pK value greater than 2.

17. The method of claim 14, wherein disposing further comprises submerging the workpiece in a bath of the etchant solution, the bath also having an electrode disposed adjacent to the workpiece, the electrode and workpiece coupled to a power supply.

18. The method of claim 17, wherein generating the electric field further comprises applying a current between about 0.05 amp to 2.0 amp to the electrode and workpiece.

19. the method of claim 18, wherein applying the current further comprises generating an etch rate between about 5 nm/sec to about 20 nm/sec.

20. The method of claim 18, wherein applying the current produces an aspect ratio value of greater than 1 for an etch depth relative to an etch width on the surface of the workpiece.

21. the method of claim 17, wherein generating the electric field further comprises applying a current between 0.05 amp to the electrode and workpiece.

22. The method of claim 17, wherein submerging further comprises forming a space about 1 mm to about 10 mm between the workpiece and the electrode.

23. The method of claim 14, wherein plating further comprises depositing an embossable layer over the NiP layer.

24. The method of claim 23, wherein depositing further comprises imprinting the embossable layer with a stamper having a template of a etch pattern to be formed on the NiP layer.

25. The method of claim 24, wherein the etch pattern comprises a discrete track recording (DTR) pattern.

26. The method of claim 25, wherein stamping further comprises ashing the embossable layer to expose the NiP layer in the recessed areas.

27. The method of claim 26, wherein generating the electric field further comprises forming a plurality of recessed areas on the surface of the NiP layer corresponding to the DTR pattern.

28. the method of claim 14, wherein the etchant solution further comprises a non-ionic surfactant.

29. the method of claim 28, wherein the non-ionic surfactant comprises an alkyl ethoxylate or an alkyl ethoxylate blend.

30. The method of claim 29, wherein the alkyl ethoxylate includes a C7-C10 alkyl chain and a molecular weight of about 550.

31. A method, comprising:

disposing a workpiece within an etchant solution having a composition comprising a dilute acid and an adsorbate, wherein the adsorbate comprises 2-benzimidazole proprionic acid;

generating an electric field within the etchant; and anisotropically etching a pattern in a surface of the workpiece, wherein the workpiece comprises a disk substrate, and wherein the method, before disposing the workpiece within the etchant, further comprises:

plating a NiP layer over the disk substrate;

depositing an embossable layer over the NiP layer; and imprinting the embossable layer with a stamper having a template of an etch pattern to be formed on the NiP layer.

32. The method of claim 31, wherein the etch pattern comprises a discrete track recording (DTR) pattern.

* * * * *

UNITED STATES PATENT AND TRADEMARK OFFICE

CERTIFICATE OF CORRECTION

PATENT NO. : 7,569,490 B2
APPLICATION NO. : 11/081326
DATED : August 4, 2009
INVENTOR(S) : Norbert Staud It is certified that error appears in the above-identified patent and that said Letters Patent is hereby corrected as shown below:

In the Claims:

Column 9, Claim 1, lines 45-46: Please delete "adsorbate comprises 2-benzimidazole proprionic acid" and insert -- etchant solution comprises a citric acid and an alkylbenzene sulfonic acid --.

Column 10, Claim 21, line 54: Please delete "17" and insert -- 7 --.

Column 10, Claim 21, line 55: Please delete "0.05 amp" and insert -- about 0.05 amp to 2.0 amp --.

Signed and Sealed this

Thirteenth Day of July, 2010

David J. Kappos

David J. Kappos
*Director of the United States Patent and Trademark Office*